US006584657B1

(12) United States Patent
Lauckner et al.

(10) Patent No.: US 6,584,657 B1
(45) Date of Patent: Jul. 1, 2003

(54) MACHINE FOR TREATING THE SURFACE OF AT LEAST ONE TEXTILE WEB OF ENDLESS FABRIC, ESPECIALLY FOR NAPPING AND/OR EMERIZING OR THE LIKE

(75) Inventors: Joachim Lauckner, Chemnitz (DE); Olaf Neumann, Sachs (DE); Joachim Georgi, Bernsbach (DE)

(73) Assignee: Xetma Gematex GmbH, Aue (DE)

( * ) Notice: Subject to any disclaimer, the term of this patent is extended or adjusted under 35 U.S.C. 154(b) by 0 days.

(21) Appl. No.: 09/600,671

(22) PCT Filed: Feb. 27, 1999

(86) PCT No.: PCT/DE99/00610

§ 371 (c)(1),
(2), (4) Date: Sep. 20, 2000

(87) PCT Pub. No.: WO99/54538

PCT Pub. Date: Oct. 28, 1999

(30) Foreign Application Priority Data

Mar. 3, 1998 (DE) ..... 198 08 804

(51) Int. Cl.[7] ..... D06C 11/00
(52) U.S. Cl. ..... 26/33; 26/29 P
(58) Field of Search ..... 26/33, 34, 35, 26/29 P, 29 R, 30, 32, 31, 36, 37, 27, 28; 28/162, 163, 165; 15/40, 88.2, 88.3, 88.4; 451/211, 271, 207, 178, 179, 184, 188

(56) References Cited

U.S. PATENT DOCUMENTS

| | | | | | |
|---|---|---|---|---|---|
| 560,207 | A | * | 5/1896 | Grosselin | 26/35 |
| 662,589 | A | * | 11/1900 | Borchers | 26/33 |
| 821,234 | A | * | 5/1906 | Glanzberg | 26/33 |
| 1,019,515 | A | * | 3/1912 | Mullers | 26/33 |
| RE13,695 | E | * | 3/1914 | Greene | 26/33 |
| 1,240,194 | A | * | 9/1917 | Gessner | 26/33 |
| 2,120,576 | A | * | 6/1938 | Scholaert | 26/34 |
| 2,128,366 | A | * | 8/1938 | Knowlton | 26/29 P |
| 2,466,348 | A | * | 4/1949 | Ambye | 26/31 |
| 2,739,366 | A | * | 3/1956 | Dourdeville | 26/34 |
| 3,102,320 | A | * | 9/1963 | Hayes | 26/31 |
| 3,175,224 | A | * | 3/1965 | Bertrand | 26/33 |
| 5,526,557 | A | * | 6/1996 | Dalla Vecchia | 26/29 P |
| 5,709,015 | A | * | 1/1998 | Denti et al. | 26/33 |
| 5,920,971 | A | * | 7/1999 | Dumas | 26/33 |
| 6,058,582 | A | * | 5/2000 | Gardner et al. | 26/33 |

FOREIGN PATENT DOCUMENTS

| | | |
|---|---|---|
| DE | 213249 | 9/1984 |
| DE | 19619894 | 6/1997 |
| WO | WO 96/23924 | 8/1996 |
| WO | WO 97/39173 | 10/1997 |

* cited by examiner

*Primary Examiner*—Amy B. Vanatta
(74) *Attorney, Agent, or Firm*—Jordan and Hamburg LLP

(57) ABSTRACT

The invention relates to a machine for treating the surface of at least one textile web of endless fabric, especially for napping and/or emerizing or the like, wherein the machine has at least a drum with a planetary-like, driven working roll (napping roll and/or emerizing roll or the like). The invention is characterized in that the drum (3) is mounted on a cylindrical support body (9) fixed on the machine frame (10) in such a way that it can rotate and be driven.

17 Claims, 1 Drawing Sheet

Figure 1:
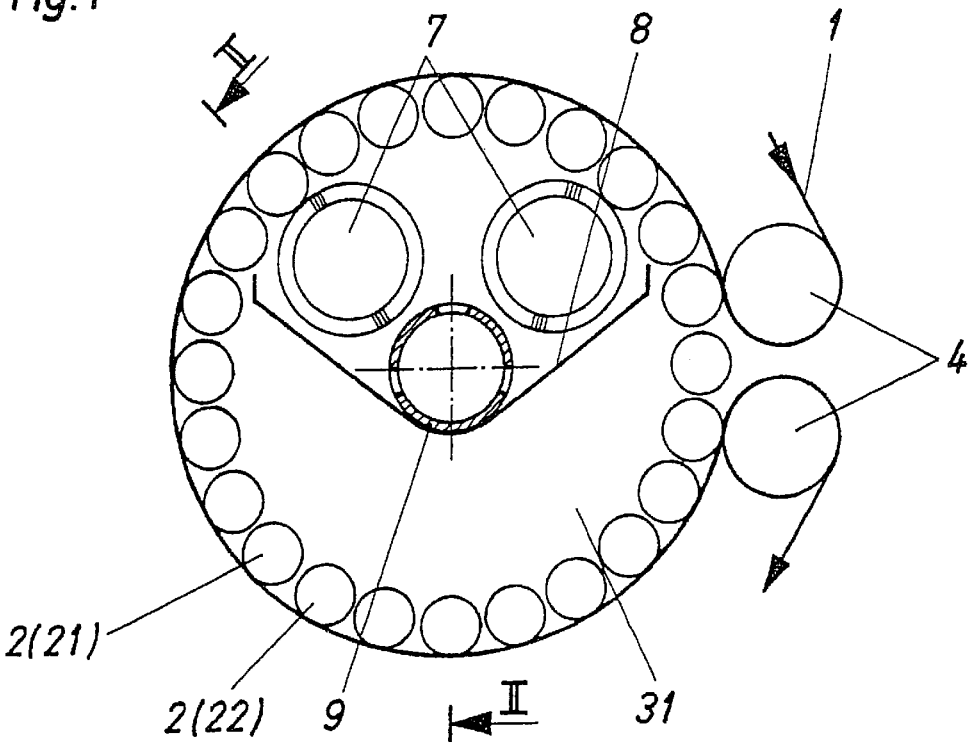

MACHINE FOR TREATING THE SURFACE OF AT LEAST ONE TEXTILE WEB OF ENDLESS FABRIC, ESPECIALLY FOR NAPPING AND/OR EMERIZING OR THE LIKE

The invention relates to a machine for treating the surface of at least one textile web of endless fabric, especially for napping and/or emerizing or the like, where the machine has at least one drum with planetary-like, driven working rolls (napping rolls and/or emerizing rolls or the like).

A napping machine is known (DE-DD-PS 213 249, in which the drum is open on the side and mounted on running rollers arranged on the inside of the drum circumference, that is, the rosette circumference. A cleaning device that serves to clean the napping rolls and is connected with a suction device located outside of the napping machine on the line side, is arranged inside the drum. This cleaning device has at least one cleaning roll arranged within a so-called dust funnel.

With this solution, it is possible to utilize the outer drum circumference as extensively as possible for the treatment process of the textile web of endless fabric. Accordingly, this increases the performance capacity of such napping machines as compared with conventional napping machines, in which the cleaning device is assigned to the outer drum circumference. The aim is to further improve this advantageous solution, with regard to mounting of the drum.

In a napping machine described in DE-PS 196 19 894, the drum is held at its two circumferential length edges, in each instance, in a ring-shaped ball bearing, approximately corresponding in size to the diameter of the drum, where the one ball bearing bushing belongs to the drum and the other ball bearing bushing belongs to the machine frame. By arranging the cleaning device inside the drum, here again it is possible, just like in the solution according to DE-DD-PS 213 249, to utilize the outer drum circumference as extensively as possible for the treatment process of the textile web of endless fabric.

However, because of the relatively large diameter of these ball bearings, the use of such bearings under these conditions of use re uires a large amount of production effort to create the surface on the machine frame onto which the bearings are screwed. For another thing, because of the large diameter of these ball bearings, and because of the rotation of the drum that is necessary for the napping process, there are relatively high circumference velocities within the bearing. These result not only in rapid wear, but also in relatively loud running noises of these bearings.

Furthermore, lubrication of these bearings must take place at relatively short intervals of operating hours, which is another disadvantage. This lubrication is not only complicated, but also re uires a special seal of the bearings and a special device for removing used grease, in order to prevent the lubricant from coming out.

For another thing, it also cannot be avoided that because of the arrangement of the gear crown that is necessary to drive the drum, on one bearing bushing in each instance, and in spite of the suction effect, part of the lint, dust and/or dirt particles that occur during the napping process will settle in the foot regions of the gear tooth pairs in each instance, which especially increases the cleaning and maintenance effort, and therefore the destruction of these bearings, that is, the gear tooth pairs, cannot be precluded.

The invention is based on the task of creating a drum bearing, particularly with a cleaning device arranged within the drum, that allows not only relatively little production effort but also greater uietness in operation, and is subject to significantly less wear.

The solution according to the invention, for a machine for treating the surface of at least one textile web of endless fabric, especially for napping and/or emerizing or the like, where the machine has at least one drum with planetary-like, driven working rolls (napping rolls and/or emerizing rolls or the like), consists in that the drum is mounted on a cylindrical support body fixed on the machine frame in such a way that it can rotate and can be driven.

The support body is rigidly attached to the machine frame, specifically by means of a releasable connection, and the bearing locations for at least one cleaning roll are attached to the support body.

The bearing locations for at least one cleaning roll arranged within the drum are arranged within the drum.

Furthermore, the dust funnel is attached to the support body, and the support body has openings, within the drum, that project predominantly into the dust funnel arranged within the drum.

At least up to its exit from the drum, the support body also forms part of a suction line leading to a suction device.

Furthermore, at least two bearing surfaces for the rosettes that help to form the drum are present on the support body. At least one rosette mounted on the support body has at least one hub for drive of the drum and/or one hub for drive of at least one cleaning roll arranged inside and/or outside of the drum. The hubs have a profile on their outside circumference as re uired in accordance with the drive means in each instance.

At least one supply and/or discharge line can be arranged within the support body.

With the solution according to the invention, mounting of the drum is improved in advantageous manner. Significant simplification of the production of the bearing surfaces for the drum takes place. For another thing, very uiet running of the drum, a reduction in maintenance effort, and a corresponding long useful lifetime of the bearing are achieved.

A significant advantage of the inventive drum bearing is also that while utilizing the advantages with regard to the arrangement of at least one cleaning device within the drum and the resulting possibility that the outside drum circumference for the treatment process of at least one textile web of endless fabric is utilized as extensively as possible, this support body can be simultaneously used as a line for suctioning off the lint, dust and/or dirt particles removed from the napping rollers using the cleaning device, that is, at least one corresponding discharge and/or supply line can be arranged in it.

The invention will be explained in greater detail below, on the basis of an exemplary embodiment. In the related drawing, FIG. 1 shows a schematic representation of a drum of a machine for napping at least one textile web of endless fabric, in cross-section, and FIG. 2 shows a cross-section along line I—I according to FIG. 1.

Figure 2:
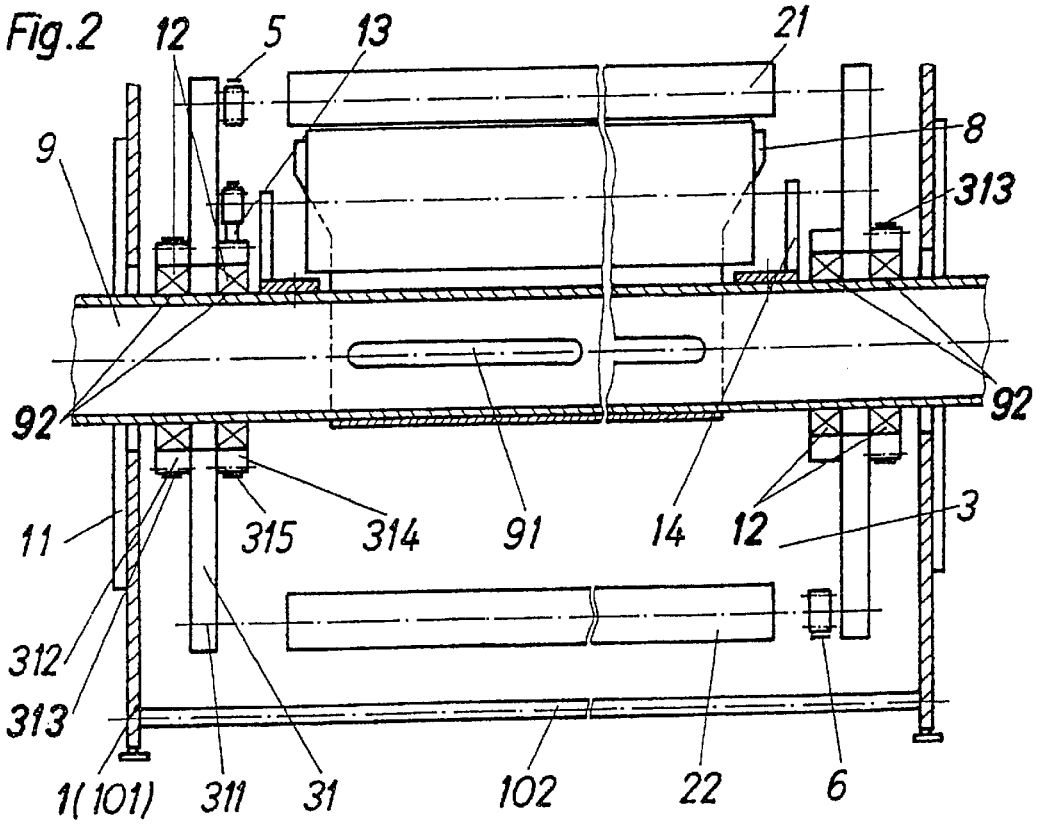

As is evident from FIG. 1 and FIG. 2, the essential elements of a machine for napping of at least one textile web 1 of endless fabric are, among others, a drum 3 e uipped with napping rolls 2, and one tension roll 4 located ahead of the drum 3 and one located behind the drum, in each instance. It is also possible to arrange a deflection roll between the drum 3 and the tension roll 4 that follows it. Because of the difference in speed between the speed of the textile web 1 of endless fabric and the circumference speed of the napping rolls 2, a napping effect is achieved on the textile web 1 of endless fabric.

The napping rolls 2 are mounted, on both ends, on the arc 311, in at least one rosette 31, in each instance, in a planetary-like bearing that can be driven. These napping rolls 2 can be structured as rolls 21 that go against the grain of the fabric and/or as rolls 22 that go with the grain of the fabric, depending on the napping effect to be achieved on the textile web 1 of endless fabric, and they can be structured in the same or a different ratio relative to one another. In the exemplary embodiment shown in FIG. 1, the ratio of the rolls 21 against the grain to the rolls 22 with the grain is 1:1. However, other ratios of rolls 21 against the grain to rolls 22 with the grain are also possible. Preferably, in this connection, the rolls against the grain are driven on the one lengthwise end of the drum, via drive means 5, and the rolls 22 with the grain are driven on the other lengthwise end of the drum, via drive means 6, at the speed and direction of rotation that is necessary in each instance.

Inside the drum 3, there are cleaning rolls 7 that serve to clean the napping rolls 2. In this connection, one cleaning roll 7 is provided for the rolls 21 against the grain, and the other cleaning roll 7 is provided for the rolls 22 with the grain. Drive of the cleaning rolls 7 thus takes place as a function of the speed of rotation of the drum 3, in such a way that the type of cleaning roll 7, in each instance, cleans the napping rolls 2 assigned to it.

The cleaning rolls 7 are located in the region of a so-called dust funnel 8. This dust funnel 8 is attached to a support body 9 with a cylindrical structure. The lint, dust and/or dirt particles removed from the napping rolls 2 using the cleaning rolls 7 are transported out of the interior of the drum 3 and thereby out of the machine by means of the openings 91 that are present in the support body 9 and predominantly project into the dust funnel 8, by a cylindrical suction device connected with the support body 9, which is not shown, and is preferably located outside of the napping machine. For this purpose, the support cylinder 9 preferably has corresponding attachment surfaces at its face ends for the channel that leads to the suction device. However, it is also possible to attach the channel leading to the suction device only at one face end of the support body 9, on the line side, while the other face end of the support body 9 is sealed. In this way, the support body 9 simultaneously forms the suction tube that leads out of the drum 3 and out of the machine frame 10, for the lint, dust and/or dirt particles removed from the napping rolls 2 using the cleaning rolls 7. However, there is also the possibility of arranging at least one corresponding discharge line within the support body 9.

Furthermore, there is the possibility of arranging at least one supply and/or discharge line, for example for lubrication of the bearings, in the support body 9.

As shown in FIG. 2, the support body 9 is preferably rigidly attached in the frame walls 101 that are part of the machine frame 10 by means of preferably one releasable clamp connection 1, in each instance. With this rigid attachment of the support body 9 in the frame walls 101, further stabilization of the machine frame 10 is achieved, along with the connections 102 that are attached between the frame walls 101 and that are part of the machine frame 10.

On the support body 9, between the frame walls 101, there are bearing seats 92 for the drum 3. For this purpose, special fittings and contact surfaces for roller bearings 12 are provided on the support body 9. To make the drawing easier to understand, the seals of the roller bearings were not shown. The drum itself is mounted in these bearing seats 92 by means of its rosettes 31. For this purpose, each rosette 31 has at least one hub. The hub 312 facing towards the frame wall 101 simultaneously serves to drive the drum 3 and, for this purpose, has a corresponding profile on its outside circumference, e.g. gear teeth 313 with a toothed belt drive. However, other types of drives are also possible, for example a V-belt drive, a chain drive or the like, in order to allow angle-synchronous drive of the drum 3.

The hub 314 that is directed into the interior of the drum 3 also has gear teeth 315 for a toothed belt drive 13 of the cleaning rolls 7. Here again, different types of drives are possible, for example a V-belt drive, chain drive or the like.

Likewise, corresponding bearing locations 14 are attached on the support body 9, inside the drum 3, in which the cleaning rolls 7 are mounted so that they can be driven.

No further details of the napping machine, such as drive, control, regulation, etc. are shown, in order to keep the drawing as simple as possible.

The invention was explained in greater detail using the example of a machine for napping at least one textile web 1 of endless fabric with twenty-four napping rolls 2. However, it is also possible to e uip the drum 3 with a different number of napping rolls 2, where the drum 3 has the corresponding size, without thereby departing from the scope of the idea of the invention.

Thus, it is also possible to replace the napping rolls 2 (a type of working roll) mounted in the drum 3, in their entirety, or only a part of the napping rolls 2, with emerizing rolls (another type of working roll), so that the drum 3 is e uipped with napping rolls and/or with emerizing rolls.

It is also possible to use other working rolls re uired for finishing textile webs of endless fabric, such as beating rolls, brushing rolls or the like, individually or in combination with at least one other type of working roll, again without departing from the scope of the idea of the invention.

Furthermore, there is also the possibility of using the support body 9 for mounting such a drum 3, which has a cleaning device 7 and 8 on its outside circumference, or at least one cleaning device 7 and 8 in the drum 3 and one on its outside circumference, in each instance.

The advantages of the solution according to the invention are not only a relatively lesser production effort, but also greater uietness of the machine in operation, and less wear of the bearing of the drum 3. In the solution according to the invention, simple replacement of the drive means, particularly the ones for the working rolls, is also advantageous.

LISTING OF THE REFERENCE SYMBOLS USED

1 textile web of endless fabric
2 napping roll
  21 napping roll against the grain
  22 napping roll with the grain
3 drum
  31 rosette
    311 arc
    312 hub
    313 gear teeth
    314 hub
    315 gear teeth
4 tension roll
5 drive means
6 drive means
7 cleaning roll
8 dust funnel
9 support body
  91 openings
  92 bearing seat

10 machine frame

101 frame wall

102 connection

11 releasable clamp connection

12 roller bearing

13 toothed belt drive

14 bearing location

What is claimed is:

1. A machine for treating the surface of at least one textile web of endless fabric, comprising:

a machine frame;

a support body fixed on the machine frame, said support body being comprised of a cylindrically-shaped tube structure; and at least one drum including driven working rolls arranged in planetary fashion, said drum being mounted on said support body in such manner that said drum can rotate about said support body and can be driven.

2. The machine according to claim 1, wherein the support body is rigidly attached in the machine frame.

3. The machine according to claim 1 or 2, wherein the support body is rigidly attached in the machine frame by structure providing a releasable connection.

4. The machine according to claim 1 or 2, further comprising bearing locations for at least one cleaning roll, said bearing locations being attached on the support body.

5. The machine according to claim 1 or 2, further comprising:

at least one cleaning roll arranged within the drum; and bearing locations for said at least one cleaning roll, said bearing locations being arranged within the drum and being attached on the support body.

6. The machine according to claim 1 or 2, wherein the drum includes at least one rosette and at least two bearing seats for said at least one rosette, said at least two bearing seats being present on the support body.

7. The machine of claim 1 or 2, wherein said drum includes at least one rosette mounted on the support body, said at least one rosette including at least one hub, said at least one hub being for at least one of drive of the drum and drive of at least one cleaning roll.

8. The machine according to claim 1 or 2, further comprising at least one rosette, said at least one rosette including at least one hub mounted on the support body, said at least one hub having a profile on an outside circumference thereof correspondingly configured with a respective drive means.

9. The machine according to claim 1 or 2, wherein at least one line serving as one of a supply and discharge line is arranged within the support body.

10. A machine for treating the surface of at least one textile web of endless fabric, comprising:

a machine frame;

a cylindrical support body fixed on the machine frame;

at least one drum including driven working rolls arranged in planetary fashion, said drum being mounted on said cylindrical support body in such manner that said drum is drivable and rotatable; and a dust funnel attached to the cylindrical support body.

11. The machine according to claim 10, wherein the cylindrical support body is rigidly attached in the machine frame.

12. A machine for treating the surface of at least one textile web of endless fabric, comprising:

a machine frame;

a cylindrical support body fixed on the machine frame;

at least one drum including driven working rolls arranged in planetary fashion, said drum being mounted on said cylindrical support body in such manner that said drum is drivable and rotatable; and a dust funnel arranged within said drum, said cylindrical support body having openings within the drum predominantly projecting into the dust funnel.

13. The machine according to claim 12, wherein the cylindrical support body is rigidly attached in the machine frame.

14. A machine for treating the surface of at least one textile web of endless fabric, comprising:

a machine frame;

a cylindrical support body fixed on the machine frame; and at least one drum including driven working rolls arranged in planetary fashion, said drum being mounted on said cylindrical support body in such manner that said drum is drivable and rotatable, the support body being structured as part of a suction line leading to a suction device at least up to an exit of said cylindrical support body from the drum.

15. The machine according to claim 14, wherein the cylindrical support body is rigidly attached in the machine frame.

16. A machine for treating the surface of at least one textile web of endless fabric, comprising:

a machine frame;

a cylindrical support body fixed on the machine frame;

at least one drum including driven working rolls arranged in planetary fashion, said drum being mounted on said cylindrical support body in such manner that said drum is drivable and rotatable;

at least one cleaning roll arranged inside the drum; and said at least one drum further including at least one rosette mounted on the cylindrical support body, said at least one rosette including a first hub for drive of the drum and a second hub for drive of said at least one cleaning roll.

17. The machine according to claim 16, wherein the cylindrical support body is rigidly attached in the machine frame.

* * * * *